US005905337A

United States Patent [19]

Dreano et al.

[11] Patent Number: 5,905,337

[45] Date of Patent: May 18, 1999

[54] ELECTROSTATIC-SHUTTER TUBE WITH FIELD-CONFORMING SHUTTER ELECTRODE

[75] Inventors: Jean-Pierre Dreano, Yerres; Jean-Philippe Boyer, Boulogne, both of France

[73] Assignee: U.S. Philips Corporation, New York, N.Y.

[21] Appl. No.: 07/949,289

[22] Filed: Sep. 22, 1992

[30] Foreign Application Priority Data

Oct. 30, 1991 [FR] France ..... 91 13403

[51] Int. Cl.[6] ..... H01J 31/50

[52] U.S. Cl. ..... 313/529

[58] Field of Search ..... 313/529, 537, 313/526, 371, 372; 250/214 VT

[56] References Cited

U.S. PATENT DOCUMENTS 3,474,275 10/1969 Stoudenheimer et al. ..... 250/214 VT
3,480,782 11/1969 Burns ..... 313/529
3,715,620 2/1973 Marro ..... 250/214 VT
3,896,331 7/1975 Enck, Jr. et al. ..... 250/214 VT
3,989,971 11/1976 Santilli et al. ..... 313/529
4,528,447 7/1985 Fitts et al. ..... 250/214 VT
4,682,021 7/1987 Fitts ..... 250/214 VT
4,814,599 3/1989 Wang ..... 250/214 VT

*Primary Examiner*—Sandra O'Shea
*Attorney, Agent, or Firm*—Robert J. Kraus

[57] ABSTRACT

An electrostatic-shutter image tube (10) has a shutter electrode (17) disposed between an electron source (12) and a focusing and accelerating electrode (13). An electron flow is propagated through a network of equipotential lines to form an image on a target (14). The shutter electrode (17) is annular and conforms with an equipotential line. Deflection electrodes (20*a*,20*b*) and an image sequencer (21) make it possible to influence the position of a sequence of small images on the target (14) where they are temporarily stored.

12 Claims, 7 Drawing Sheets

ELECTROSTATIC-SHUTTER TUBE WITH FIELD-CONFORMING SHUTTER ELECTRODE

BACKGROUND OF THE INVENTION

The invention relates to an electrostatic-shutter image tube comprising:

an electron source for emitting a flow of electrons in response to an incident photon image, the flow of electrons being propagated in the tube through a network of equipotential lines, means for focusing and accelerating said electrons, shutter means, situated between the electron source and the focusing and accelerating means, for interrupting the electron flow, and a target on which the electron flow inscribes a final image.

The invention also relates to an image-pick-up device comprising such an image tube.

When picking-up images, it must generally be possible to interrupt or effect the image pick up in a very short time. Such a mode of operation is determined either by a need to form a rapid sequence of pictures or by a characteristic of the target.

This is, for example, the object of United States Patent Document U.S. Pat. No. 4,528,447 in which a description is given of an electrostatic shutter tube comprising orthogonal pairs of deflection plates. A shutter electrode G1 is manufactured in the form of a cylinder which is provided with a grid. The shutter electrode is disposed between a photocathode and a focusing electrode G2. The photocathode, which receives the incident image to be detected, has a curved surface. The length of the cylindrical shutter electrode G1 is approximately equal to its radius of curvature. Thin, regularly-spaced metal wires assume the shape of a segment of sphere, which is substantially identical to that formed by the concave photocathode, and extend opposite the photocathode.

Such a grid is difficult to manufacture.

When the shutter is "open" during operation, electric fields $E_1$ and $E_2$ on both sides of the slits defined by the spaces between the wires must be equal in order not to produce unidirectional microlenses which would have a substantial negative influence on the quality of the final image. The condition $E_1=E_2$ can be fulfilled by adjusting the potential $V_{G1}$ of the electrode G1 because, in practice, the potential $V_{G2}$ of the electrode G2 is determined by the focusing conditions. The potential of G1, which is positive with respect to the photocathode in the open mode of operation, becomes slightly negative to drive back the photoelectrons emitted at a certain initial speed in the closed mode of operation. The electrode G2 is not involved in the shutter operation, because it is situated at a substantial distance from the photocathode and is shielded by the relatively large electrode G1, so that the potential of G2 need not be modulated to improve the shuttering sensitivity.

Moreover, the presence of grid wires may cause problems regarding the manufacture of the photocathode when the latter is manufactured "in situ", because the grid slightly masks the evaporation of the constituents Sn, Cs, K which serve to form the photocathode. Besides, stray emissions may occur at the wires during the operation of the tube.

SUMMARY OF THE INVENTION

It is an object of the invention to obviate these problems in order to obtain an electrostatic shutter image tube which is much easier to manufacture and which enables instantaneous shutter control currents to be used which are weaker and hence easier to control. This object is achieved by means of an image tube provided with shutter means which comprise an annular shutter electrode having a central aperture E through which the electron flow passes. Around the central aperture E, the electrode has a rim of small thickness and of a shape such that the rim substantially conforms to an equipotential line in order that, during transmission, the shutter electrode does not disturb the network of equipotential lines.

The term "rim" is to be understood to mean herein a portion near the center of the electrode which may comprise half the electrode; the external portion, which is located near the envelope of the tube, being defined by mechanical requirements regarding the fixation and electrical requirements regarding the electrical insulation.

The shutter electrode is given the shape of the equipotential lines of an identical tube which is not provided with a shutter electrode. Consequently, it should have a very small thickness, so that the transmission of the flow of electrons remains unchanged. The electrons pass through the central aperture which is not obstructed by a network of metal wires.

The shutter electrode must be very accurately shaped, because instead of a narrow electron beam a total two-dimensional image is transmitted. Thus, degradation in the form of distortions, particularly, on the contour of the image are not permitted. Ideally, the shutter electrode should have a thickness which is substantially equal to zero. Since this is impossible in practice, it is given a minimal thickness (for example less than 0.2 mm) at the rim of the central aperture, which thickness increases progressively in the direction of the periphery of the tube.

A side of the shutter electrode which faces the focusing means should be most rigorously defined. This side should extend parallel to the equipotential line on which the shutter electrode is superposed. Thus, the equipotential lines adjoining the shutter electrode at both sides are not modified with respect to an identical tube which is not provided with the shutter electrode. For this reason, the shutter electrode is defined such that the rim is situated in a zone where the equipotential lines form monotonic curves extending substantially parallel to each other.

The shuttering sensitivity can be defined as the ability of the tube to shutter the electron flow by means of a weak control voltage. The shuttering sensitivity of the shutter electrode can be increased by reducing the diameter of the central aperture. This diameter is determined as a function of the dimensions of the electron source, which is preferably a photocathode. Preferably, the ratio of the diameter of the central aperture to the diameter of the photocathode ranges approximately between 1 and 2. The shuttering sensitivity can also be modified by changing the distance between the shutter electrode and the photocathode. Preferably, the distance between the center of the central aperture and the center of the photocathode is equal to approximately a quarter of the diameter of the central aperture.

Thus, by virtue of the shape and the location of the shutter electrode, the shutter electrode does not form a shield between the focusing electrode and the photocathode.

The shutter operation can alternatively be controlled by simultaneously influencing the shutter electrode and the focusing means.

BRIEF DESCRIPTION OF THE DRAWING

The invention will be explained in greater detail by means of the following drawing figures, which are to be regarded as non-limitative examples, and in which.

DESCRIPTION OF THE PREFERRED EMBODIMENTS

In the description, a tube which receives an incident image and produces a final image independent of the type of target is termed an "image tube". When the image tube comprises specific means which enable the final image to appear in the form of a video or other type of electric signal, the image tube is termed an "image-pick-up tube".

Figure 1:
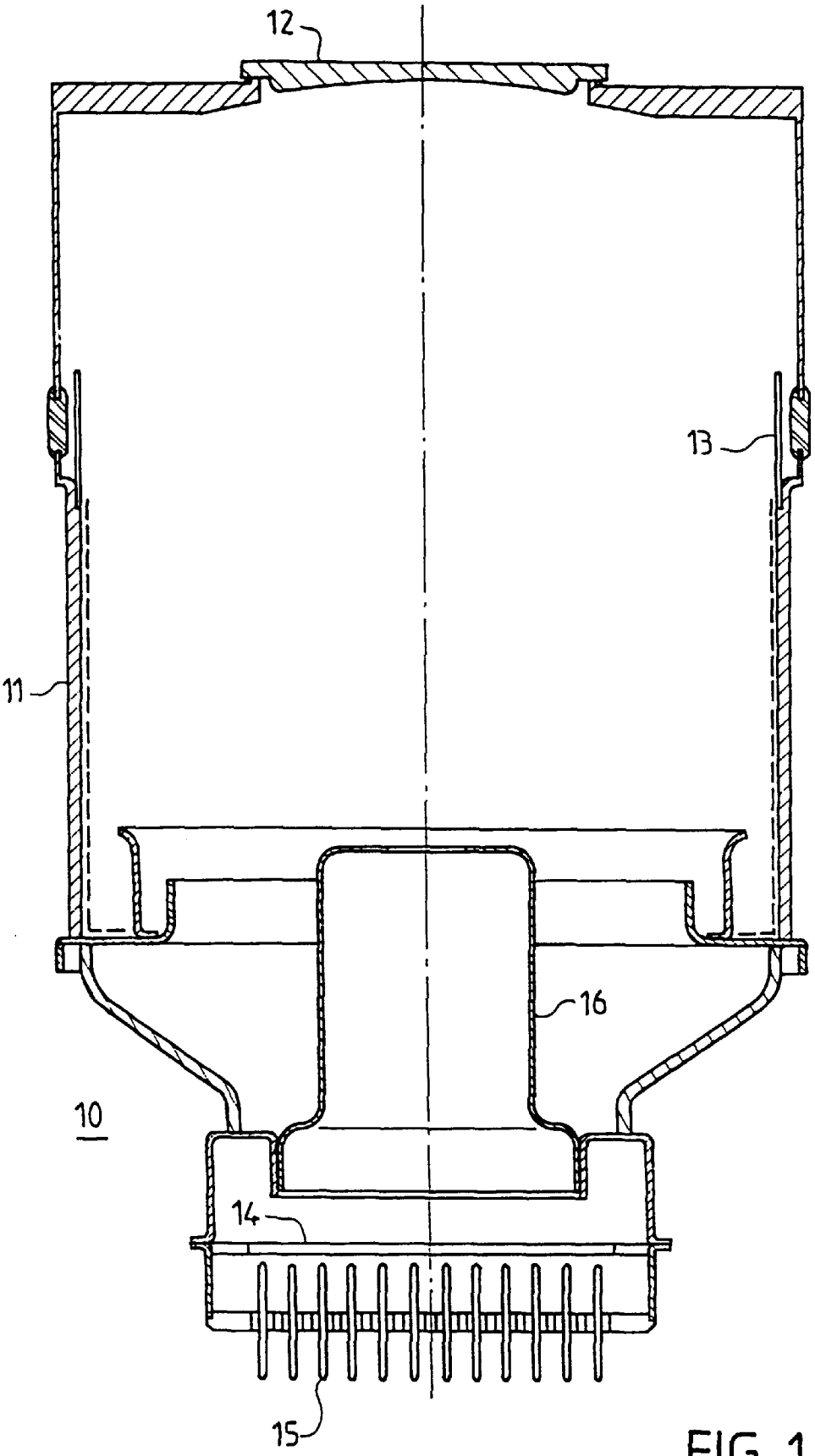
FIG. 1 diagrammatically shows an image-pick-up tube which includes an image tube, but which does not include a shutter electrode, and which includes a target consisting of a charge-transfer device (CTD)

FIG. 1 diagrammatically shows an example of an image pick-up tube 10 having an image tube comprising:

an envelope 11 which may consist of glass, a photocathode 12 which receives an incident image and converts the image into a flow of electrons, an electrode G2 13 which focuses the electrons and which is formed by a metal extension of the envelope 11, an anode 16, a target 14 which consists of a charge-transfer device (CTD), means 15 for applying electric signals to and extracting electric signals from the target.

The image-pick-up tube target may include a luminescent screen which is, for example, deposited on optical fibers. In this case, the means 15 which transform the image tube to an image pick-up tube are formed by, for example, a charge transfer device coupled to the luminescent screen by the optical fiber.

Figure 2:
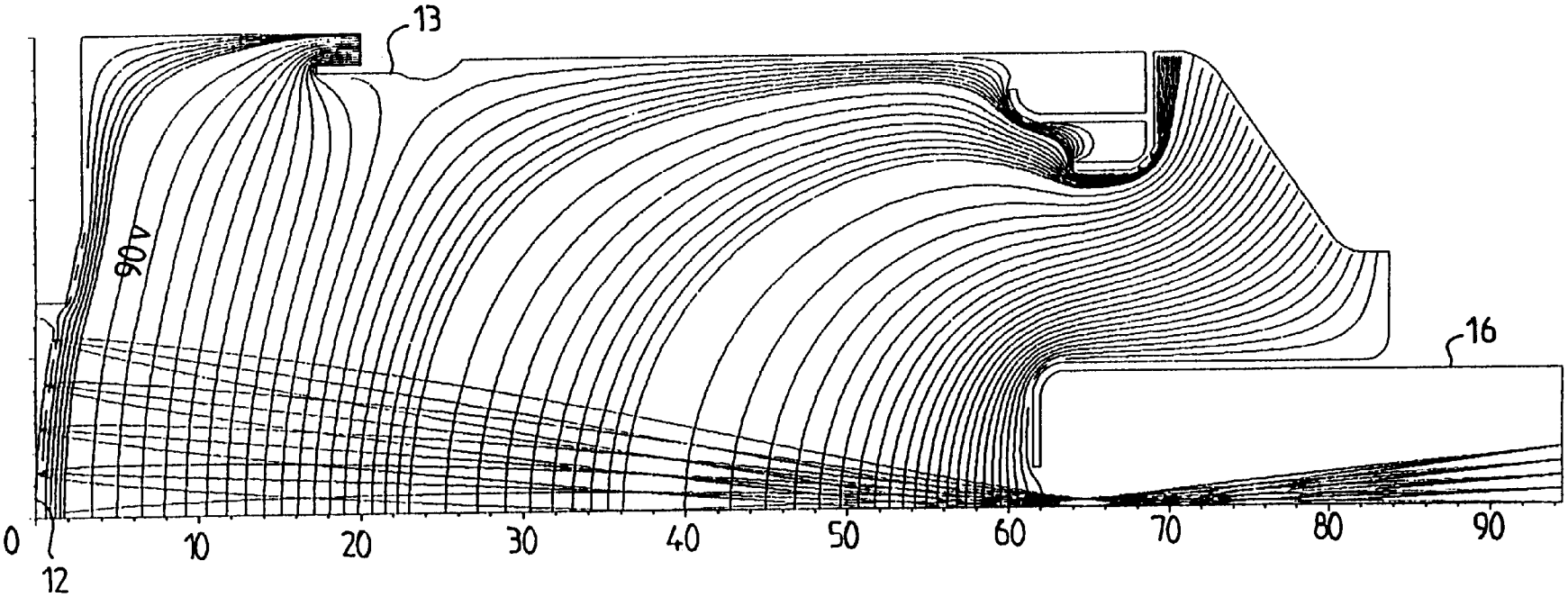
FIG. 2 shows equipotential lines and electron paths in the tube shown in FIG. 1.

FIG. 2 shows the equipotential lines and the electron paths of the electrons forming the final image, for the tube of FIG. 1. The following voltages are applied:

voltage of the photocathode 12: 0 volt, voltage of the anode 16 and the target 14: 14,000 volts, voltage of the electrode G2 13 (focusing electrode): 365 volts.

The equipotential lines are successively spaced from the photocathode to the anode by steps of 5 volts, 30 volts, 100 volts and 500 volts.

Figure 3:
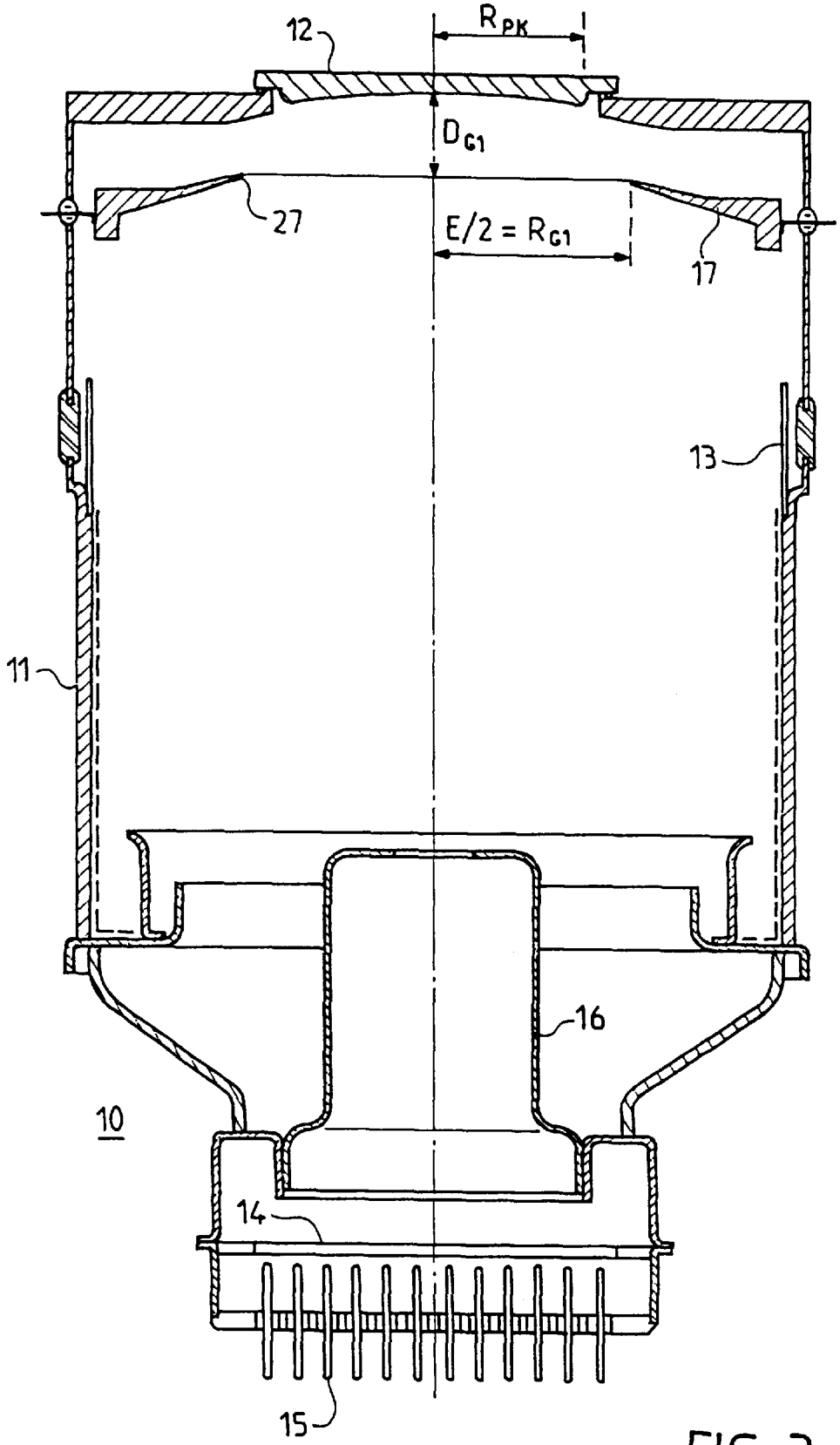
FIG. 3 shows an image pick-up tube having a shutter electrode.

FIG. 3 is a diagrammatic view similar to that of FIG. 1, a shutter electrode G1 17 being disposed between the photocathode 12 and the focusing electrode G2 13.

Figure 4:
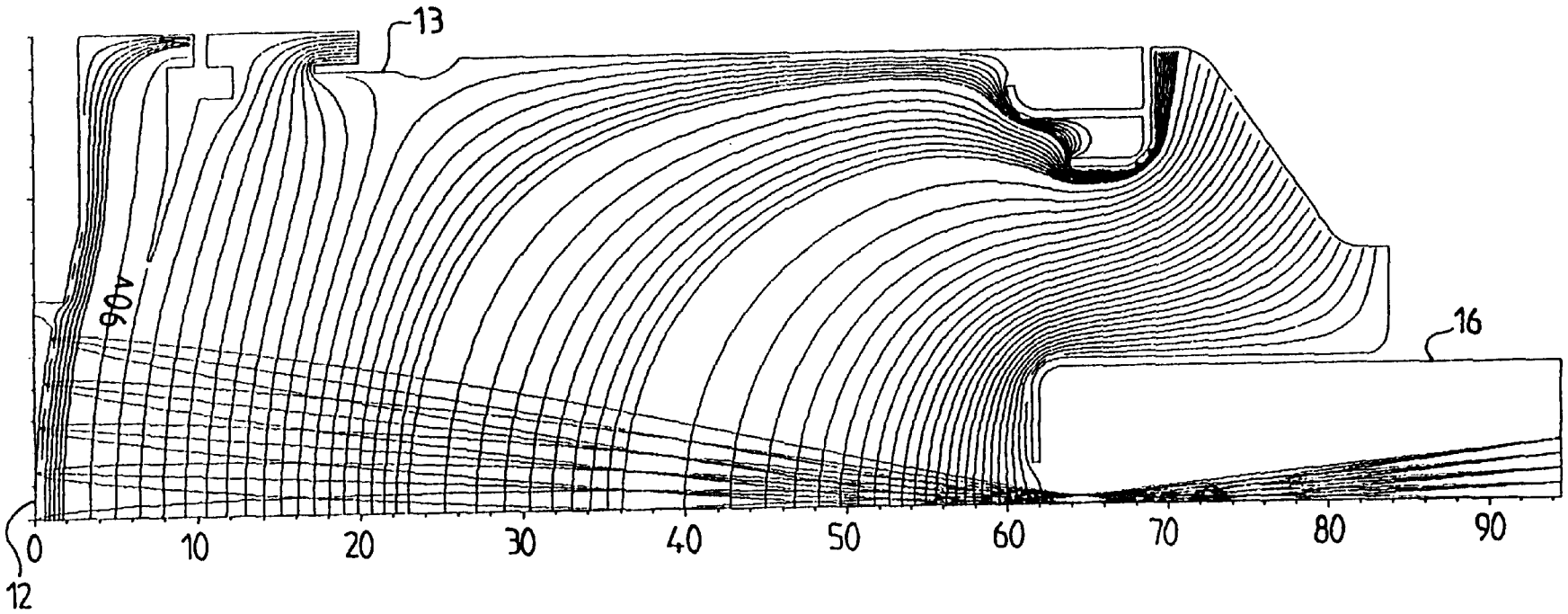
FIG. 4 is a representation similar to that shown in FIG. 2, comprising a shutter electrode which is superposed on the equipotential line of 90 volts (transmission mode of the electron image)

FIG. 4 shows equipotential lines and electron paths for the image pick-up tube shown in FIG. 3. The shutter electrode G1 17 is biased at 90 volts in order to be superposed on the equipotential lines of 90 volts. In comparison with FIG. 2, the electron flow remains unchanged. This annular shutter electrode is located at a substantial distance from the electron beam and, hence, its concentricity is not critical. The rim 27 (FIG. 3) around the central aperture is very important from an electron optical point of view: the thickness of the shutter electrode G1 and its inclination with respect to the tube axis are also important.

The central portion of the shutter electrode G1 (FIG. 3) preferably consists of a spherical segment of very small thickness (for example 0.1 mm) the shape of which corresponds as much as possible to that of the previously-calculated equipotential line shown in FIG. 2. If the shutter electrode G1 is to be machine-turned in one piece, preferably the walls are manufactured so as to have a straight cross-section (the walls flaring out slightly to obtain a high rigidity). The largest angle is the angle of the wall facing G2: it is approximately equal to the mean angle of the equipotential line formed in this zone and is possibly optimized to obtain the results illustrated in FIG. 4, which correspond to a minimum of final image errors (i.e. a minimum of non-linearity and loss of resolution at the edges). Thus, the results perfectly match those shown in FIG. 2.

As regards the exemplary construction of the tube shown in FIG. 3, this angle should be 73 degrees with respect to the axis. Of course, a different construction could lead to a different angle.

The above construction defines an aperture E of G1 having a diameter $2R_{G1}$=32 mm for an emissive diameter of $2R_{PK}$=22.4 mm of the photocathode, i.e., a ratio of 32/22.4=1.43, which determines, in particular, the quality of the final image.

If less stringent requirements were to be imposed on the quality of the edges of the final image, the action of shutter electrode G1 could be augmented by moving the edge of the electrode defining the aperture closer to the edge of the electron flow. For example, the aperture of G1 could be reduced to 26 mm (instead of 32 mm), which would lead to a ratio of 1.16 and, hence, would allow a reduction of the amplitude of the electric shuttering pulse.

An analogous improvement of the shuttering sensitivity can be obtained, at a substantially constant quality of the final image, by also reducing the emissive diameter in the same proportion, i.e. by changing it to 18.2 mm (to re-obtain the ratio 1.43=26/18.2). It is noted that, for this purpose, a mask of suitable dimensions and defining the emissive surface is applied to the support of the photocathode on the outside of the tube.

In other words, one and the same tube may have a high shuttering sensitivity and an average quality of the edges of the final image or a high shuttering sensitivity and a smaller, yet high-quality, final image.

The edge of the shutter electrode G1 may have a thickness of 0.2 mm (next to the edge of the electron flow) without adversely affecting the results. A larger thickness of the edge of the electrode, which would simplify the manufacturing process, is only taken into consideration when less stringent demands are imposed on the quality of the edges of the final image.

The position of the shutter electrode 17 should not be randomly selected. In the above-described construction, the distance DG1 between its aperture-defining edge and the tangent plane at the center of the photocathode is 7 mm (in which case $DG1/2R_{G1}\approx 0.22$).

If the distance DG1 is reduced, the electron path blocking sensitivity is slightly improved at the edge of the electron beam but not at the center of the beam (around the axis). Besides, the stray capacitance $C_p$ increases because of the proximity of shutter electrode $G_1$ and of the support for the photocathode 12. In the case of a greater reduction of DG1, the shutter electrode G1 leaves the zone where the equipotential lines correspond to each other and the shutter electrode can no longer be correctly electrically compensated.

If, shutter electrode on the other hand, G1 is too far from the photocathode, the latter drawback will occur and the shuttering sensitivity of the beam will decrease.

Figure 5:
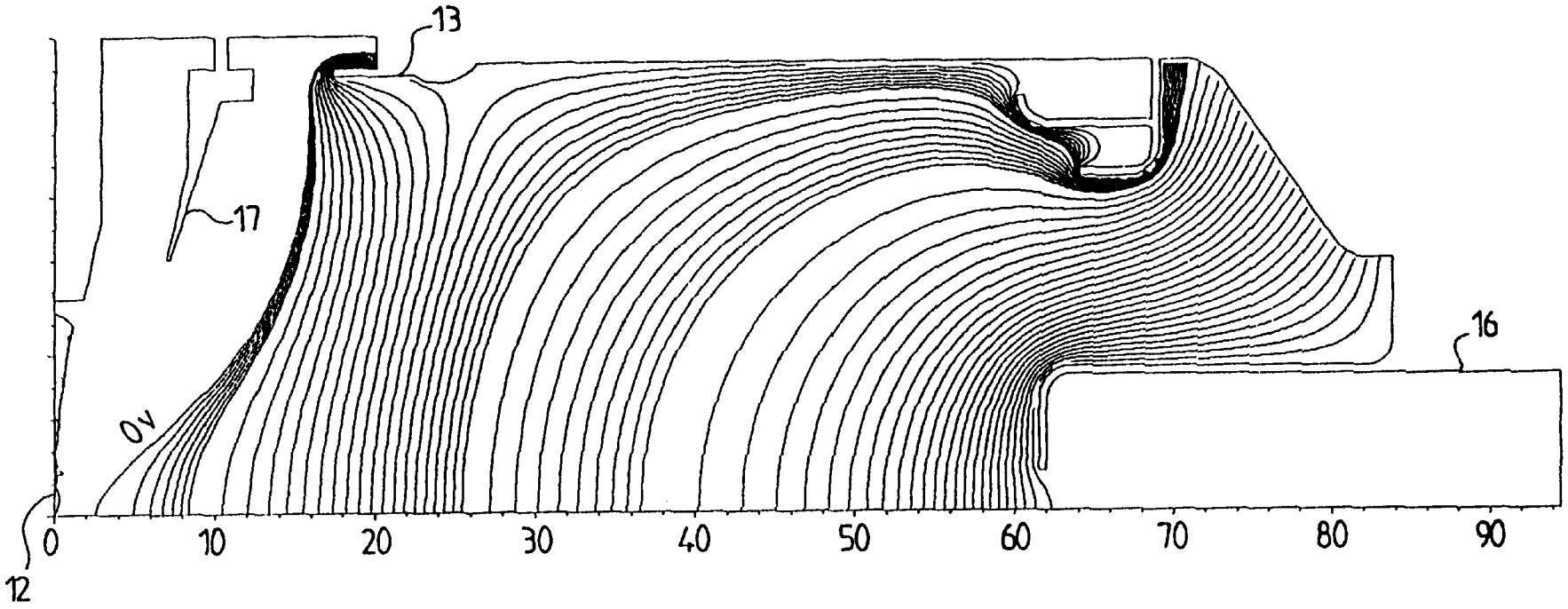
FIG. 5 is a representation similar to that of FIG. 4, but depicting the shuttering mode.

FIG. 5 shows how the electron flow is shuttered when the shutter electrode G1 17 is negatively biased (the focusing electrode G2 13 retains its nominal focusing value $VG_2$=365 volts). The 0-volt equipotential line links up again with the axis, near the center of the photocathode 12, thereby defining a cut-off. Between the photocathode and the 0-volt equipotential line, the equipotential lines are negative and the electric field is initially repellent in the vicinity of the photocathode. Furthermore, when calculating the paths of emitted electrons, it is observed how the paths of electrons which are emitted at a certain initial speed retrogress right from the first calculation steps. To obtain this result, a voltage of $V_{G1}$ −360 volts should be applied to the shutter electrode, which means that a transition from the "blocked" state to the "unblocked" state takes place with a pulse of 90-(−360)=450 volts.

By virtue of its shape and position in the tube, the shutter electrode G1 has a low electric capacitance relative to its environment. This is advantageous for the generation of shutter control pulses. Such pulses must allow, possibly large, instantaneous currents to be supplied. The current I can be expressed by $$I = C\frac{dV}{dt}$$

where:

C=the capacitance of shutter electrode G1 relative to its entire environment (total capacitance), dV=|V|, amplitude of the square wave signal, dt=t, the desired shuttering time which may be of the order of one nanosecond.

The total capacitance consists of:

$C=C_o+C_p$, where $C_o$ is the capacitance of shutter electrode G1 relative to the useful area of the photocathode, and $C_p$, the stray capacitance, comprises the remaining capacitance (capacitance of shutter electrode G1 relative to the focusing electrode G2, the accelerating electrode, the shielding of the tube . . . and relative to the support for the photocathode).

Thus:

$$I = \frac{V}{t}(C_o + C_p)$$

The modulation sensitivity is proportional to $C_o$:

$$V = \frac{k}{C_o}$$

When G1 approaches the emissive surface the flow of the field formed on said surface increases and, consequently, this results simultaneously in an increase of $C_o$ and of the effect on the emission control.

The preceding equation can be rewritten as:

$$I = \frac{k}{t}\left(1 + \frac{C_p}{C_o}\right)$$

To reduce the instantaneous value of the current, the ratio $C_p/C_o$ must be minimized.

Moreover, the shutter electrode can be opened completely to allow passage of the wide beam emitted by the photocathode. Then the shutter electrode G1 does not form a shield between the photocathode and the focusing electrode G2 so that it is possible to simultaneously apply shutter voltages to the shutter electrode G1 and the focusing electrode G2.

Figure 6:
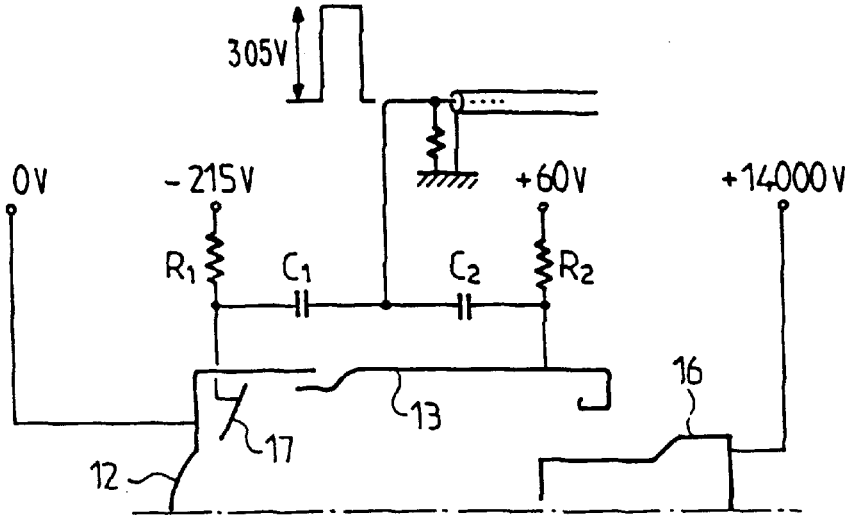
FIG. 6 is an electrical diagram of the voltages applied to the tube, FIG. 7 diagrammatically shows a part of an image tube having a shutter electrode and a modified focusing electrode, FIG. 8 diagrammatically shows a part of the image pick-up tube having a target which is formed from a luminescent screen, optical fibres and a charge-transfer device, FIG. 9 diagrammatically shows a part of an image tube which additionally comprises deflection means.

FIG. 6 shows how shuttering of the electron flow is effected by combining a negative bias applied to shutter electrode G1 with a reduction of the bias applied to focusing electrode G2. It is of course desirable to pass from the "blocked" state to the "unblocked" state by means of one and the same unblocking pulse applied to electrodes G1 and G2. In these conditions the cut-off state is attained at $V_{G1}$=−215 volts and $V_{G2}$=+60 volts, so that the unblocked state which characterizes the nominal operation of the tube is attained by superposing one and the same short pulse of 305 volts on said biases:

$V_{G1}$=−215+305=90 volts $V_{G2}$=+60+305=365 volts.

The bias is applied through resistors $R_1$ and $R_2$ which are electrically connected to shutter electrode 17 and focusing electrode 13, respectively. The pulse is applied via the capacitances $C_1$ and $C_2$.

The indicated voltages (in FIG. 6) are correct for a target consisting of an electroluminescent screen, i.e. having an electron source at 0 volt and an anode at 14,000 volts. If the target is a charge-transfer device, the electron source is at −14,000 volts and the anode is at 0 volt. In this case 14,000 volts must be subtracted from the voltages indicated in FIG. 6.

Thus, with the simultaneous use of focusing electrode G2 and annular shutter electrode G1 approximately 50% can be gained on the modulation sensitivity.

Figure 7:
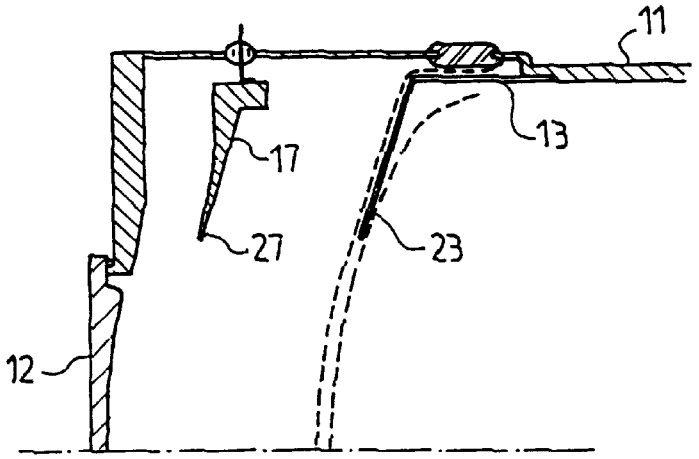

The concept of the invention can also be used to increase the sensitivity of the focusing electrode G2 13. FIG. 7 shows that the input of the focusing electrode G2 can be provided with a thin cylindrical flange 23 the shape of which corresponds to the equipotential line which links-up again with the focusing electrode G2 in the transmissive mode of the electron flow.

Figure 8:
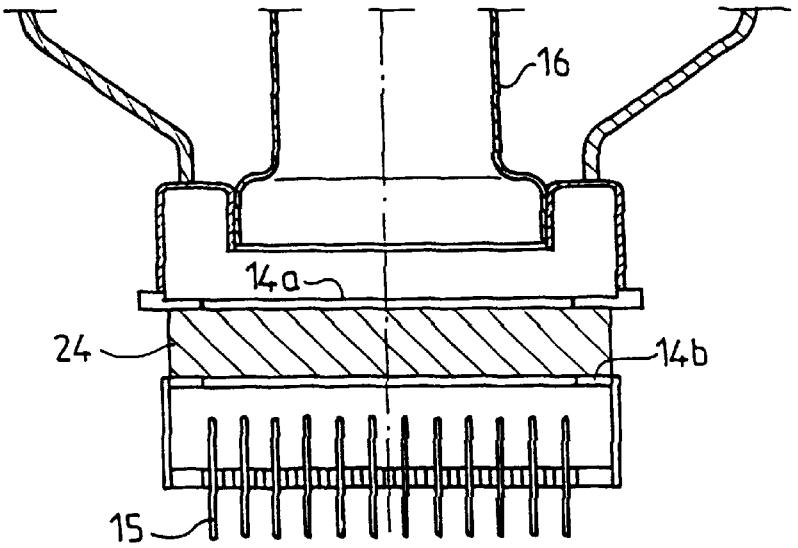

The target of such an image tube may consist of an electroluminescent screen or a charge-transfer device which is sensitive to the electron flow. FIG. 8 diagrammatically shows a part of an image pick-up tube in which the target 14 consists of a luminescent screen 14*a* which is coupled to a charge transfer device 14*b* by means of an optical fiber device 24. Thus, the electron flow is transformed to a photon flow by the luminescent screen 14*a*. Subsequently, the photon flow is detected by the charge transfer device 14*b*.

Figure 9:
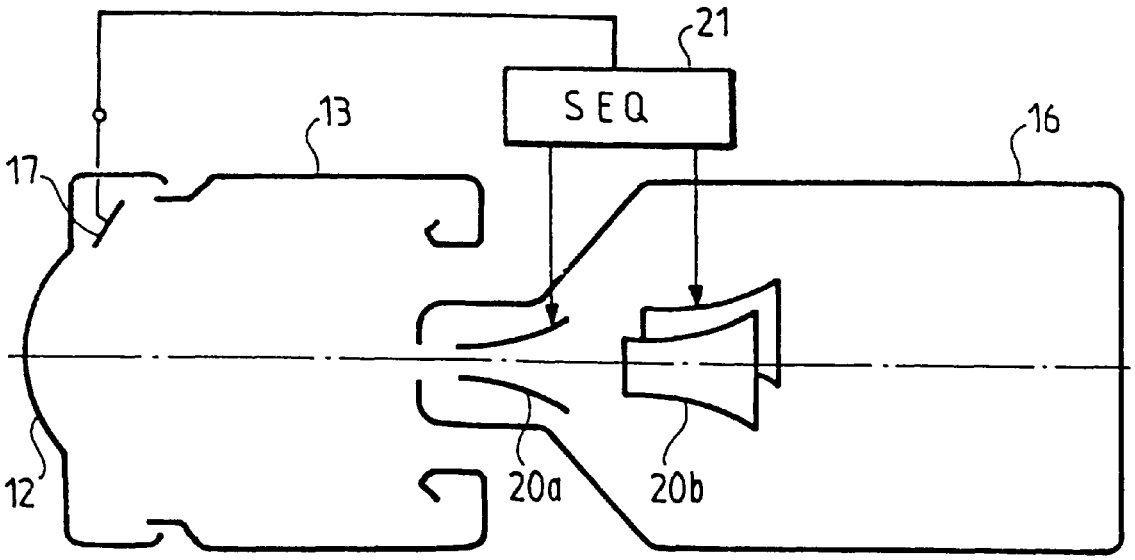

The image tube may also comprise electrostatic deflection means 20*a*, 20*b* in the space next to the target (FIG. 9). The position of the final image on the target can thus be influenced. For this purpose, a final image is produced which occupies only a part of the target. This is achieved either by constructing the tube to produce such an image or, if the tube is already constructed to produce an image which occupies the full target area, by masking the throughput of the photocathode. A sequence of reduced final images may represent a sequence of different final images which are consecutively picked-up by the image pick-up tube. Consequently, the shuttering means and the deflection means must be synchronized by means of an image sequencer 21.

Figure 10:
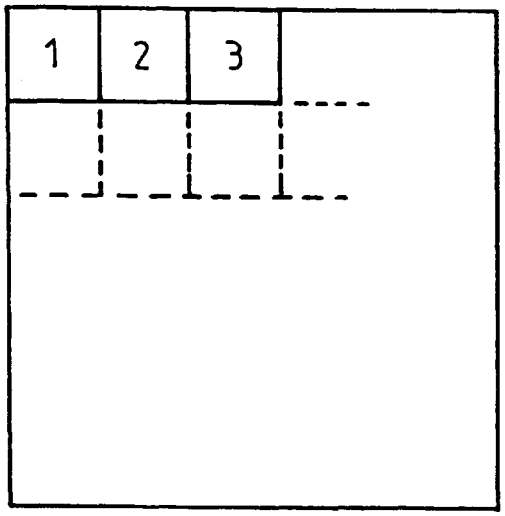
FIG. 10 shows a sequence of images on the screen.

This structure is particularly interesting in the case of high-speed cinematography, in which it is then possible to examine a sequence of different final images 1, 2, 3 . . . (FIG. 10). In such a sequence of images, an isolated event in one of the final images can be trapped by stopping the sequencer or one event can be followed at a high temporal resolution.

In order to carry out an "off-line" examination of the information elements contained in a sequence of final images, it must be possible to stop the acquisition of final images at a given instant, in particular, when the target consists of a charge-transfer device (CTD) which is sensitive to the electron flow.

In conventional high-speed video image processing using a charge-transfer device, the acquisition of a sequence of images consists of a succession of recording cycles (exposure) and reading cycles. The image repetition rate is a function of the time necessary for each of said cycles. The limitation of the device in accordance with the state of the art emanates from the reading of the pick-up device. To increase the image repetition rate ($F_T$), the read-time must be decreased by reducing the number of pixels to be used. Such reduction of the number of pixels leads to a reduction of the spatial resolution of the charge transfer device and hence of the image inscribed (expressed by the number of pixels per image); this reduction is obtained:

by constructing a charge transfer device with a small number of pixels, or, if charge-transfer device technology permits, by regrouping a plurality of adjacent pixels to form macro-picture elements or, possibly, by using only a part of the charge transfer device.

Increasing the repetition rate by reducing the spatial resolution not only has a limited importance because of a loss of information, but also has physical limitations. The maximum passband of the pick-up device is limited by the maximum frequency of the video signal, i.e. by the time necessary to read a pixel. The time is determined by the technology used to manufacture charge transfer devices.

If also a reduction of the spatial resolution is acceptable, it is possible, in accordance with the invention, to reduce the image itself so that a sequence of reduced images can be inscribed, before extracting data, on the entire sensitive zone of the charge transfer device. The sequence of reduced images is obtained at an acquisition rate which is independent of the read time of the charge-transfer device, which rate can be very high provided that rapid shuttering between a reduced image and the next reduced image can be effected in order to avoid streaks in the image, which are particularly disturbing when the deflection time becomes substantially equal to the exposure time.

For obtaining very high repetition rates it is desirable to limit the exposure time, i.e. to use a target having a high detection sensitivities. This can be achieved by directing the electron flow onto the rear face of an electron-sensitive charge-transfer device. To maximize the detection sensitivity (up to the detection of a single electron) use can be made of a charge transfer device having a thickness on the order of ten microns.

The fact that the acquisition rate is independent of the data read time (i.e. of the number of pixels to be read) makes it possible to use charge-transfer devices of large dimensions having a large number of pixels. This makes it possible to obtain reduced images having a high resolution.

For example, a shuttering time of approximately 10 ns has been achieved with an image pick-up tube comprising the shutter electrode. Thus, using a charge transfer device having 1024×1024 pixels, and reduced final images having 64×64 pixels, a sequence of 256 reduced final images can be picked-up. At a shuttering time of 10 ns between two final images, during which time the deflection means deflect the electron flow by one image step, and at an acquisition time of 40 ns for a reduced final image, it is possible to record a sequence of final images for 50 ns×256=12.80 microseconds. Subsequently, this sequence of images can be extracted entirely from the charge transfer device and then analyzed.

This method considerably enhances the speed as compared with the method in which data are extracted after each reduced final image inscribed in the charge transfer device.

We claim:

1. An electrostatic shutter tube for producing a representation of a photon image, said tube comprising:

a. an electron source for emitting a flow of electrons in response to an incident photon image;

b. a target on which an image may be inscribed by incident electrons;

c. first electrode means disposed between the electron source and the target for producing an electric field, defined by a multiplicity of equipotential lines having predetermined shapes, for accelerating the flow of electrons toward the target and focusing said flow of electrons at said target;

d. shutter electrode means for facilitating interruption of the flow of electrons from the electron source to the target, said shutter electrode means having a rim with an edge defining an aperture for passing the flow of electrons, said rim being positioned in a location where one of said equipotential lines is to be produced, having a shape substantially conforming to the predetermined shape of said line, and having a minimal thickness at least at said edge, such that, during transmission of the flow of electrons through the aperture, the shutter electrode does not substantially disturb the equipotential lines of the electric field produced by the first electrode means.

2. An electrostatic shutter tube as in claim 1 where the first electrode means comprises a focusing electrode and an anode.

3. An electrostatic shutter tube as in claim 1 where the equipotential lines in the location where the rim is positioned for monotonic curves extending substantially parallel to each other.

4. An electrostatic shutter tube as in claim 1 or 3 where the ratio of the width of the aperture to the width of the electron source ranges approximately between 1 and 2.

5. An electrostatic shutter tube as in claim 1 or 3 where the distance between the center of the aperture and the center of the electron source is equal to approximately one-quarter of the width of the aperture.

6. An electrostatic shutter tube as in claim 1 or 3 where the thickness of the rim is less than approximately 0.2 mm.

7. An electrostatic shutter tube as in claim 1 or 3 where the first electrode means includes a focusing electrode, and where the electron flow to the target is blocked by simultaneously applying predetermined respective voltages to the shutter electrode and to the focusing electrode.

8. An electrostatic shutter tube as in claim 1 or 3 where the first electrode means includes a focusing electrode having, at an end facing the electron source, a flange portion with a shape substantially conforming to one of said equipotential lines.

9. An electrostatic shutter tube as in claim 1 or 3 where the target comprises a charge-transfer device.

10. An electrostatic shutter tube as in claim 1 or 3 where the target comprises a luminescent screen which is coupled to a charge-transfer device by optical fiber means.

11. An electrostatic shutter tube as in claim 1 or 3 including deflection means for influencing the position where the flow of electrons is incident on the target.

12. An electrostatic shutter tube as in claim 11 including an image sequencer for controlling the deflection means.

* * * * *